US005522906A

United States Patent [19]

Hashimoto et al.

[11] Patent Number: 5,522,906

[45] Date of Patent: Jun. 4, 1996

[54] GASOLINE COMPOSITION

[75] Inventors: Jiro Hashimoto; Shogo Nomoto; Hitoshi Funada, all of Wakayama, Japan

[73] Assignee: Kao Corporation, Tokyo, Japan

[21] Appl. No.: 231,043

[22] Filed: Apr. 22, 1994

[30] Foreign Application Priority Data

| | | | |
|---|---|---|---|
| Apr. 22, 1993 | [JP] | Japan | 5-095926 |
| May 11, 1993 | [JP] | Japan | 5-109459 |
| Oct. 1, 1993 | [JP] | Japan | 5-246897 |
| Oct. 13, 1993 | [JP] | Japan | 5-256009 |
| Dec. 22, 1993 | [JP] | Japan | 5-323960 |
| Dec. 22, 1993 | [JP] | Japan | 5-323961 |
| Dec. 22, 1993 | [JP] | Japan | 5-323962 |
| Dec. 22, 1993 | [JP] | Japan | 5-323963 |

[51] Int. Cl.[6] ..... C10L 1/22; C10L 1/18

[52] U.S. Cl. ..... 44/400; 44/435; 44/412; 44/426; 44/331

[58] Field of Search ..... 44/400, 412, 426, 44/435, 331

[56] References Cited

U.S. PATENT DOCUMENTS

| | | | |
|---|---|---|---|
| 3,622,519 | 11/1972 | Braxton, Jr. | 44/400 |
| 3,658,495 | 4/1972 | Dorer, Jr. | 44/400 |
| 3,836,469 | 9/1974 | Miller | 44/400 |
| 4,565,548 | 1/1986 | Davis | 44/400 |
| 5,211,721 | 5/1993 | Sung et al. | 44/400 |

*Primary Examiner*—Jacqueline V. Howard

*Attorney, Agent, or Firm*—Oblon, Spivak, McClelland, Maier & Neustadt

[57] ABSTRACT

A gasoline composition comprising (a) gasoline, (b) a deposit inhibitor or a detergent containing a basic nitrogen atom, (c) a carrier oil, and (d) one or more compounds selected from the group consisting of an ester of a fatty acid and an alkylene oxide addition compound to bisphenol, a compound obtained by the ester exchange reaction of an alcohol and a triglyceride-type fat or oil, an aliphatic or aromatic carboxylic acid, a metal salt of an aliphatic or aromatic carboxylic acid, an ester of an aliphatic or aromatic carboxylic acid and an alcohol, and an ester of boric acid. The composition has superior heat resistance and is excellent in removing deposits in the fuel intake systems and in keeping the systems clean.

12 Claims, No Drawings

GASOLINE COMPOSITION

BACKGROUND OF THE INVENTION

1. Field of the Invention

The present invention relates to a gasoline composition exhibiting an excellent detergent effects on the fuel intake system.

2. Description of the Background Art

Deposits and sludges produced in the fuel system and the combustion chamber of internal combustion engines are known to decrease the functions of the engines and also to have an adverse effect on exhaust gas. Deposits produced in intake valves and intake ports reduce output power of the engine, decrease driving performances, and increase the amount of exhaust gases. Performances of engines are being more and more promoted in recent years, and these high performance engines are more sensitive to these deposits.

Deposits in intake valves, in particular, cause serious problems in electronic controlled fuel injection systems, of which the use is recently increasing in passenger cars. Although these systems, which strictly control the fuel-air mixture, not only promote the engine performances but also are effective for energy saving and exhaust gas control, this fuel-air mixture control system ceases to correctly function if gasoline injected from the injection system comes into contact with deposits attached to the intake valves. The resulting malfunction of the fuel-air mixture control system seriously affects the drivability of the automobile.

Various gasoline additives are added to gasoline in order to prevent accumulation of deposits in fuel intake systems, such as carburetors and intake valves, to remove deposits therefrom, and to clean combustion chambers.

Compositions comprising a detergent, which is an oil-soluble active component containing a basic nitrogen such as amino group or amide group, and a carrier oil, which is typically a mineral or synthetic oil, are conventionally known as gasoline additive compositions. The detergent acts on soils and dirts which may deposit on the intake system to keep this system clean. The carrier oil is used to keep the detergent active. High boiling-point and high viscosity oils having excellent heat stability are usually used as a carrier oil. These oils have a function of a dispersing agent, by which the detergent is kept active. They also have a function of protecting metal surfaces in the intake system by forming liquid films. Polyolefins, polyoxyalkylenes (Japanese Patent Publication (kokoku) No. 48556/1981), esters, and the like are known as synthetic oils used as the carrier oil.

In order to adapt to engines of which the performances are more and more promoted in recent years, a high level of detergency is required for intake systems, particularly for intake valves. In particular, in order to enable the detergent to exhibit its actions more effectively, the carrier oil must be sufficiently heat resistant (intake valves are at 200°–300° C.), must have good compatibility with the detergent, and must well dissolve soils and dirts (oxidated or deteriorated matters from fuels and engine oils) in the intake system.

With the object of satisfying these requirements, some fuels and gasoline additives have been proposed, including (1) a fuel for internal combustion engines, in which two different types of compounds are used as carrier oils (Japanese Patent Application Laid-open (kokai) 173194/1990); (2) a fuel additive composition comprising a polyether amine-type compound (U.S. Pat. No. 5,018,029); and (3) a fuel additive composition comprising a polyether compound and a compound having an amine-type nitrogen atom and an oxyalkylene group or a polyamine (Japanese Patent Application Laid-open (kokai) 114089/1992).

These gasoline additives and gasoline compositions are not satisfactory in their detergent effects.

Development of a gasoline composition having a further improved detergent effect has therefore been desired.

SUMMARY OF THE INVENTION

Accordingly, an object of the present invention is to provide a gasoline composition comprising, (a) gasoline, (b) 1–10,000 ppm of a deposit inhibitor or a detergent containing a basic nitrogen atom, (c) 1–10,000 ppm of a carrier oil, and (d) one or more heat resistance improvers selected from the group consisting of, (d-1) an ester of a fatty acid and an alkylene oxide addition compound, wherein the compound to which the alkylene oxide is added has the following formula (1),

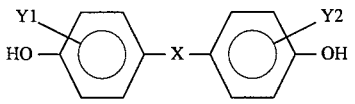

(1)

wherein X represents

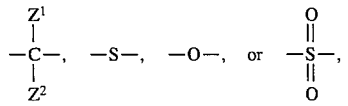

(wherein $Z^1$ and $Z^2$ are individually a hydrogen atom, a trifluoromethyl group, or a substituted or unsubstituted alkyl or alkenyl group having 1–6 carbon atoms, or a phenyl group), and $Y^1$ and $Y^2$ are individually a hydrogen atom or a substituted or unsubstituted alkyl or alkenyl group having 1–6 carbon atoms, or a phenyl group, (d-2) a compound obtained by the ester exchange reaction of an alcohol and a triglyceride-type fat or oil or an alkylene oxide adduct thereof, (d-3) an aliphatic or aromatic carboxylic acid having 12–30 carbon atoms, (d-4) a metal salt of an aliphatic or aromatic carboxylic acid having 4–30 carbon atoms, (d-5) an ester of an aliphatic or aromatic carboxylic acid having 12–30 carbon atoms and an alcohol having 1–8 carbon atoms, and (d-6) an ester of boric acid.

The gasoline composition of the present invention exhibits more improved heat resistance and a better detergent effect than conventional compositions containing the above-described components (a), (b), and (c). In particular, it has remarkably improved deposit removing properties from the gasoline engine intake systems and greatly promoted detergent capability which lasts over a long period of time.

Other and further objects, features and advantages of the present invention will be more fully evident from the following description.

DETAILED DESCRIPTION OF THE INVENTION AND PREFERRED EMBODIMENTS

There are no specific limitations to the gasoline which is used as component (a) in the composition of the present invention, so long as the gasoline is that for use in spark-ignition engines, such as automobile gasoline and aircraft gasoline. Reformed gasoline, low-leaded gasoline, clear gasoline, and the like are included.

The compound containing a basic nitrogen atom, component (b), is added to the composition of the present invention as a deposit inhibitor or a detergent. Any compounds containing a basic nitrogen atom which are commonly used as a detergent for fuel intake systems can be used as component (b) without any specific limitations. Polyether amine-type compounds, long-chain alkylamine compounds, long-chain alkenylamine compounds, benzylamine compounds, and succinimide compounds are given as examples. Among these, polyether amine-type compounds, long-chain alkylamine compounds, and long-chain alkenylamine compounds are preferred, with particularly preferred being polyether amine-type compounds.

Compounds represented by the following formula (2) can be given as specific polyether amine-type compounds.

$$R^1—O(A^1O)_n—A^2—X^1 \quad (2)$$

wherein $R^1$ represents an alkyl or alkylphenyl group having 1–50 carbon atoms, $A^1O$ is an alkylene oxy group having 2–6 carbon atoms, $A^2$ is a group,

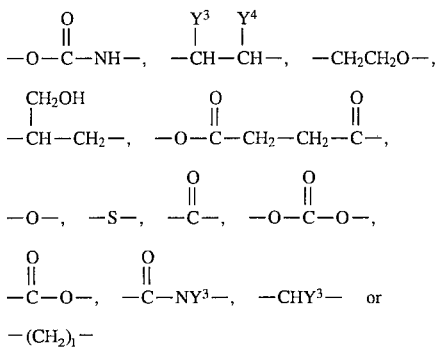

(wherein $Y^3$ and $Y^4$ individually represent a hydrogen atom, or a methyl, ethyl or carboxy group, and l is an integer of 3–5), and $X^1$ represents a group,

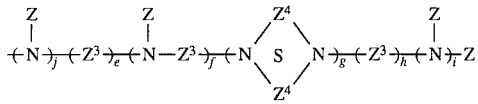

(wherein Zs may be the same or different and individually represent a hydrogen atom, a hydrocarbyl group having 1–10 carbon atoms, or a hydrocarbonyl group having 2–10 carbon atoms; $Z^3$s may be the same or different and individually represent and alkylene group having 2–6 carbon atoms, which may be substituted by a hydroxy group; $Z^4$ represents a carbonyl, alkylene carbonyl, or alkylene group which has an adjacent bonding and 2–4 carbon atoms; e is 0 or 1, preferably 1; f is 0–4, preferably 0–2; g is 0 or 1, preferably 0; h is 0 or 1, preferably 0; i is 0 or 1, preferably 1; j is 0 or 1, provided that j must be 1 when g is 0; and n is an integer of 1–50).

There are no specific limitation to the structure of alkylene oxide group, $A^1O$, in formula (2) of the compound. Any alkylene oxide groups with an optional structure, including those added by an isomer mixture thereof, can be used.

Among these, the compounds of the following formula (2-a) described in U.S. Pat. No. 5,089,029 are especially preferred.

$$R^1—O—(A^1O)_n—(C_3H_6NH)_mH \quad (2\text{-a})$$

wherein m is an integer of 1–3, and $R^1$, $A^1$, and n are the same as defined above. Among the compounds of formula (2-a), those having $R^1$ containing 10–50 carbon atoms and $A^1$ containing 2–4 carbon atoms are particularly preferred. U.S. Pat. No. 5,089,029 is herein incorporated by reference.

As the long-chain alkylamines or the long-chain alkenylamines, compounds of the following formula (3) can be given.

$$R^2—(NHCH_2CH_2)_d—NH—X^2 \quad (3)$$

wherein $R^2$ represents a long-chain alkyl or alkenyl group having a molecular weight of at least 700, $X^2$ represents a hydrogen atom or a long-chain alkyl or alkenyl group having a molecular weight of at least 700, and "d" denotes an integer of 0–5.

Polyolefin residues, such as polyethylene, polypropylene, and polybutene, are given as the long-chain alkyl or alkenyl groups for $R^2$ or $X^2$ in formula (3). Compounds having an integer of 1–5 for "d" are preferred.

A typical example of the compound represented by formula (3) can be prepared by chlorinating a polyolefin and reacting the chlorinated polyolefin with a polyamine.

The amount of component (b) to be incorporated for providing good deposit inhibition or detergent effects to the composition of the present invention is 1–10,000 ppm, preferably 10–1,000 ppm.

As the carrier oil of component (c), an alkylene oxide adduct to an alcohol or an alkylphenol having 10–50 carbon atoms, as a major component, is preferred, even though mineral oils and synthetic oils are well acceptable.

Given as the alcohol having 10–50 carbon atoms are various natural saturated or unsaturated alcohols, linear monohydric alcohols produced by the Ziegler method, and branched alcohols obtained by the oxo reaction or the Guerbet reaction. Specific examples of these alcohols include natural alcohols, such as decyl alcohol, lauryl alcohol, palmityl alcohol, stearyl alcohol, eicosyl alcohol, behenyl alcohol, oleyl alcohol, elaisyl alcohol, and erca alcohol; linear monohydric alcohols having 10–30 carbon atoms produced by the Ziegler method; branched alcohols having 10–24 carbon atoms produced by the oxo reaction; and branched alcohols having 16–24 carbon atoms produced by the Guerbet reaction.

As alkylphenols having 10–50 carbon atoms, those having one or two alkyl groups having 4–40 carbon atoms, particularly 4–30 carbon atoms are preferred. Specific examples which can be preferably used are butylphenol, amylphenol, octylphenol, nonylphenol, dinonylphenol, dodecylphenol, cumylphenol, alkylphenols having $C_{18}$–$C_{24}$ alkyl groups, and alkylphenols obtained by reacting a $C_6$–$C_{30}$ α-olefin and phenol.

As the alkylene oxide added to these alcohols or alkylphenols, those having 2–6, especially 3–4, carbon atoms, are preferred. There are no specific limitation to the structure of the alkylene oxide. Any isomers or mixtures thereof can be used. The number of mols of the alkylene oxides added is preferably 10 or more. If the number of mols of alkylene oxides added is smaller than 10, the detergency effects at the intake valve are poor. Although the upper limit of the number of mols is not specifically limited, the products with more than 50 mols of alkylene oxides added are difficult to manufacture, and are thus uneconomical.

These alkylene oxides may be added to the above-mentioned alcohols or alkyl phenols by a conventional method. For example, the alkylene oxide may be reacted by adding it either in a liquid or gaseous state to the alcohol in the presence of sodium hydroxide while heating and optionally using a suitable solvent. The random addition polymerization, in which a mixture of two or more kinds of alkylene oxides are reacted, and the block addition polymerization, which consists of successive reactions of different kinds of alkylene oxides, are also applicable.

Esterified or etherified compounds of the alkylene oxide adduct to alcohol or alkyl phenol may also be used as the component (c). The esterified compounds include esters of $C_1$–$C_{20}$ fatty acids among the above-mentioned fatty acids, and the etherified compounds include ethers of $C_1$–$C_{21}$ alcohols, for example, alcohols having 20 or smaller carbon atoms among the above-mentioned alcohols, such as methanol, ethanol, propanol, or butanol.

The amount of component (c) to be incorporated for providing excellent detergent effects to the composition of the present invention is 1–10,000 ppm, preferably 10–1,000 ppm.

The component (d) of the composition of the present invention is particularly useful for improving heat resistance. The addition of this component, however, increases not only the heat resistance, but also the detergency effect and the long-lasting effect of the detergent capability.

Component (d-1) is an ester of a fatty acid and an alkylene oxide adduct of the compound represented by the formula (1). In formula (1), included in the substituted or unsubstituted alkyl or alkenyl group having 1–6 carbon atoms for $Z^1$, $Z^2$, $Y^1$, and $Y^2$ are alkyl groups, alkenyl groups, hydroxyl-substituted alkyl groups, and hydrocarbyl-substituted alkyl groups. Of these, unsubstituted alkyl or alkenyl groups, particularly unsubstituted alkyl groups, are preferred. Given as examples of $C_1$–$C_6$ alkyl groups which can be preferably used include methyl, ethyl, n-propyl, iso-propyl, n-butyl, iso-butyl, sec-butyl, tert-butyl, n-pentyl, and n-hexyl groups.

Specific examples of the compound of formula (1) are bisphenol A, bisphenol F, bisphenol C, bisphenol E, bisphenol Z, bisphenol S, bisphenol AF, bisphenol AP, diisopropylbisphenol A, 1,1-ethylidene-bisphenol, methyl-ethyl-methylene-bisphenol, methyl-isobutyl-methylene-bisphenol, methyl-hexyl-methylene-bisphenol, methyl-phenyl-methylene-bisphenol, and 4,4-thiodiphenol.

As the alkylene oxide to be added to the compound of formula (1), those having 2–6 carbon atoms, especially 2–4 carbon atoms, are preferred. Specific examples of the alkylene oxide include ethylene oxide, propylene oxide, and butylene oxide. The average number of mols of the alkylene oxide to be added is 1–30, and preferably 1–5 mols. If this number of mols exceeds 30, the addition compound obtained is too viscous to be adequately fluid.

Fatty acids having 1–30 carbon atoms, preferably 5–20 carbon atoms, are used for forming esters with these alkylene oxide addition compounds. Specific fatty acids include acetic acid, propionic acid, n-butanoic acid, iso-butanoic acid, n-pentanoic acid, iso-pentanoic acid, n-hexanoic acid, 2-ethylbutanoic acid, cyclohexanoic acid, n-heptanoic acid, iso-heptanoic acid, methylhexanoic acid, n-octanoic acid, dimethylhexanoic acid, 2-ethylhexanoic acid, 2,4,4-trimethylpentanoic acid, iso-octanoic acid, 2,5,5-trimethylhexanoic acid, n-nonanoic acid, iso-nonanoic acid, iso-decanoic acid, iso-undecanoic acid, 2-butyloctanoic acid, dodecanoic acid (lauric acid), tridecanoic acid, tetradecanoic acid, hexadecanoic acid, and octadecanoic acid.

The addition reaction of the compound of formula (1) and the alkylene oxide, and the reaction of the thus-obtained alkylene oxide addition compound and the fatty acid can be carried out by conventional methods. The conversion rate of the resulting ester, which is component (d-1), is preferably 50–100% based on the hydroxy groups of the alkylene oxide addition compound.

Component (d-2) used in the present invention is a compound obtained by the ester exchange reaction of an alcohol and a triglyceride-type fat or oil or an alkylene oxide adduct thereof. Vegetable oils, such as coconut oil, palm oil, and soybean oil; animal oils, such as tallow oil and whale oil; and fish oils, are given as examples of the triglyceride-type fat or oil. They may be used either singly or in combination of two or more.

These triglyceride-type fats or oils may be used after addition of alkylene oxides. Alkylene oxides having 2–6, particularly 2–4, carbon atoms can be preferably used for this purpose. There are no specific limitations to the structure of such alkylene oxides. Any isomers or mixtures of alkylene oxides can be used. The number of mols of alkylene oxides to be added is preferably 2–30. If this number of mols exceeds 30, the resulting addition compound has a high viscosity and is less fluid.

Either monohydric or polyhydric alcohols may be used as the alcohol for the ester exchange reaction. Linear or branched alcohols are given as examples of monohydric alcohols. These alcohols specifically include propanol, butanol, pentanol, hexanol, octanol, decyl alcohol, lauryl alcohol, palmityl alcohol, stearyl alcohol, eicosyl alcohol, behenyl alcohol, oleyl alcohol, elaisyl alcohol, and erca alcohol. Given as examples of polyhydric alcohols are glycerine, trimethylolpropane, pentaerythritol, mesoerythritol, sorbitol, ethylene glycol, and propylene glycol.

Among these alcohols, those having a molecular weight of 200 or smaller are particularly preferred.

The ester exchange reaction can be carried out by a conventional method, for example, a triglyceride-type oil or fat, or an alkylene oxide added compound thereof, is reacted with an alcohol under heating in the presence of a catalyst such as anhydrous potassium carbonate using, if necessary, a suitable solvent. The molar ratio of the triglyceride-type oil or fat, or the alkylene oxide added compound thereof, and the alcohol is preferably 1:0.1–1:5, and particularly preferably 1:0.5–1:2.

These compounds for the component (d-2) is preferable in view of the availability at a low cost, the excellent biodegradable characteristics, and the minimal risks of causing environmental pollution.

Given as examples of the carboxylic acid for component (d-3) are saturated fatty acids, such as lauric acid, myristic acid, stearic acid, palmitic acid, alkylmalonic acid, and alkylsuccinic acid; unsaturated fatty acids, such as oleic acid, linoleic acid, and linolenic acid; aromatic carboxylic acids, such as alkylsalicylic acid. Beside these carboxylic acid compounds, fatty acid mixtures of animal or vegetable origin which contain these carboxylic acids, such as soybean fatty acid, rapeseed fatty acid, tallow oil fatty acid, and castor oil fatty acid, can also be used.

As examples of the carboxylic acid for the metal salt of carboxylic acid for component (d-4), alkylmalonic acid, alkylsuccinic acid, alkenylsuccinic acid, and alkylsalicylic acid can be given. As the salts of the carboxylic acid, salts of alkali metal, such as lithium, sodium, and potassium; and salts of alkaline earth metal, such as barium, calcium, and strontium, can be given.

The same carboxylic acids used as component (d-3) can be used as the carboxylic acid for forming the ester of component (d-5). Given as examples of the alcohol for forming the esters are monohydric alcohols, such as methyl alcohol, ethyl alcohol, propyl alcohol, butyl alcohol, and amyl alcohol; and polyhydric alcohols such as glycerine. Typical examples of the ester derived from these carboxylic acids and alcohols are methyl ester of tallow oil, butyl ester of tallow oil, butyl stearate, diethyl alkylmalonate, methyl ester of castor oil, methyl alkyl($C_{16}$)salicylate, glycerol mono-oleate, and the like.

Borates containing or not containing nitrogen can be used as component (d-6). More particularly, products obtained by the reaction of boric acid and an alcohol selected from monohydric alcohols, polyhydric alcohols, partial esters of polyhydric alcohol, monoalkanol amines, dialkanol amines, and trialkanol amines can be given as the component (d-6).

Among these, the products obtained by the dehydration reaction of an amine containing hydroxy group and boric acid can be given as nitrogen-containing borates. Specific examples are the reaction products of boric acid and an amine compound represented by the following formula (4),

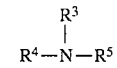

(4)

wherein $R^3$ is a hydrogen atom or an alkyl group having 1–20 carbon atoms, and $R^4$ and $R^5$, which may be the same or different, represent a group,

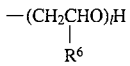

(wherein $R^6$ is a hydrogen atom or a methyl group, and l is a number of 1–10) or an alkyl group having 1–20 carbon atoms, provided that both $R^4$ and $R^5$ are not alkyl groups at the same time.

Included in the amine compounds of the above formula (4) are alkanol amines, such as ethanolamine and isopropanolamine; N-alkyl diethanolamines such as N-butyldiethanolamine; and N-alkyl isopropanolamines. The following compounds are given as typical examples of the borates obtained by the reaction of N-butyldiethanolamine and boric acid at the amine and boric acid molar ratio of 2:1.

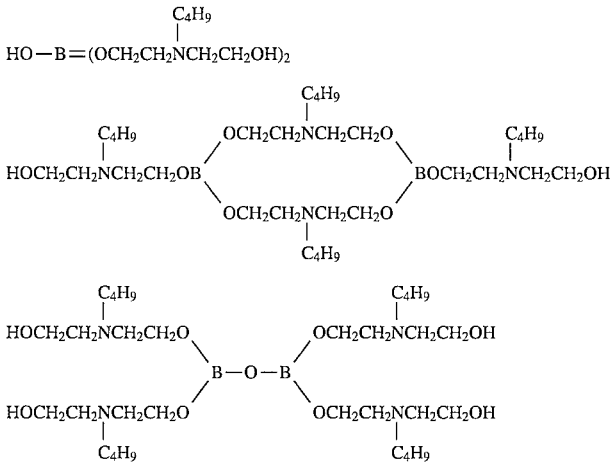

Further, given as examples of borates not containing nitrogen are reaction products of boric acid and a monohydric alcohol, a polyhydric alcohol, or a partial ester of polyhydric alcohol, for example, (poly)alkylene glycol borates, such as glycerol borate stearate, glycerol borate oleate, triethylene glycol monomethyl ether triborate, and polyoxyethylene glycerol borate stearate.

These components (d-1) to (d-6) may be used either individually or in combination of two or more.

Among components (d-1) to (d-6), (d-1) is particularly preferred for providing the gasoline composition with not only heat resistance but also detergency and a long-lasting effect of the detergency. Component (d-2) is preferred due to its biodegradable properties. Due to these characteristics possessed by components (d-1) and (d-2) their combined use is also preferred.

The amount of component (d) to be incorporated for providing excellent heat resistance, detergency, and long-lasting effect of the detergency to the composition of the present invention is 1–5,000 ppm, preferably 3–500 ppm.

The ratio by weight of components (b) to (d) in the gasoline composition of the present invention is (b):(d)=99.5:0.5 to 70:30, particularly preferably 99:1 to 80:20. The ratio by weight of components (b) to (c) is (b):(c)=5:95 to 95:5, particularly preferably 40:60 to 90:10. Further, the ratio by weight of components (b)+(c) to component (d) is 99.5:0.5 to 70:30, preferably 99:1:to 80:20, and particularly preferably 98:2 to 90:10.

The total amount of components (b), (c) and (d) in the gasoline composition of the present invention is 3–25,000 ppm, and preferably 5–20,000 ppm, and particularly preferably 10–15,000 ppm.

There are no specific limitation to the method of the addition of components (b) to (d). It is possible to prepare a mixture of two or more of the components (b), (c) and (d) in advance and to add this mixture to component (a), or to add the components (b), (c) and (d) separately to component (a). Only incorporation of these components in gasoline in whatever manner is required.

Beside the above-described essential components, any additives, such as rust preventives, anti-emulsion agents, antioxidants, and metal deactivators, may be added to the gasoline composition of the present invention.

Japanese Patent Application No. 95926/1993 filed on Apr. 22, 1993, Japanese Patent Application No. 109459/1993 filed on May 11, 1993, Japanese Patent Application No. 246897/1993 filed on Oct. 1, 1993, Japanese Patent Application No. 256009/1993 filed on Oct. 13, 1993, Japanese Patent Application No. 323960/1993 filed on Dec. 22, 1993, Japanese Patent Application No. 323961/1993 filed on Dec. 22, 1993, Japanese Patent Application No. 323692/1993 filed on Dec. 22, 1993, and Japanese Patent Application No. 323693/1993 filed on Dec. 22, 1993 are herein incorporated by references.

Other features of the invention will become apparent in the following description of the exemplary embodiment which is given for illustration of the invention and is not intended to be limiting thereof.

EXAMPLES

Example 1

A test engine was driven in the test mode described below using the gasoline additive compositions of the formulation shown in Tables 1–4. The amounts of deposits were measured after the drive.

Gasoline which produces deposits in an amount of 1305 mg or 1310 mg per valve in this test was used as the fuel. The gasoline additive compositions were added to this gasoline in the amounts shown in Tables 1–4. The results are given in Tables 1–4.

Test engine: Toyota 1G-EU engine (trademark, manufactured by Toyota Motor Corp., 2000 cc)

Test mode: One cycle

| | |
|---|---|
| Idling | 30 seconds |
| 1300 rpm | 60 seconds |
| 1850 rpm | 120 seconds |
| 3000 rpm | 60 seconds |

Test hour: 120 hours (1600 cycles)

The following compounds were used for preparing the compositions for the test.

A-1: Lauric acid diester of ethylene oxide adduct (2 mols) to bisphenol A

A-2: 2,5,5-Trimethylhexanoic acid diester of propylene oxide adduct (10 mols) to bisphenol A A-3: n-Octanoic acid diester of butylene oxide adduct (5 mols) to bisphenol A A-4: An ester exchange reaction product obtained by the reaction of coconut oil and butanol (molar ratio=1:2) at 200° C. with the addition of anhydrous potassium carbonate A-5: A product obtained in the same manner as A-4 from (i) an ethylene oxide (10 mol) adduct to palm oil and (ii) glycerine (molar ratio, (i):(ii)=1:0.8)

A-6: A product obtained in the same manner as A-4 from (i) a propylene oxide (5 mol) adduct to soybean oil and (ii) trimethylol propane (molar ratio, (i):(ii)=1:0.5)

A-7: Stearic acid

A-8: Oleic acid

A-9: Glycerol mono-oleate

A-10: Butyl stearate

A-11: Potassium salt of methyl alkyl($C_{16}$) salicylate

A-12: Sodium isobutenyl succinate

A-13: A reaction product of polyoxyethylene alkyl amine (Amiet 102: trademark, manufactured by Kao Corp.) and boric acid (molar ratio 1:1)

A-14: A reaction product of N-butyldiethanolamine and boric acid (molar ratio 2:1)

A-15: Glycerol borate oleate (Emulbone S-80: trademark, manufactured by Toho Chemical Co., Ltd.)

A-16: Polyoxyethylene glycerol borate palmitate (Emulbone T-40: trademark, manufactured by Toho Chemical Co., Ltd.)

B-1:

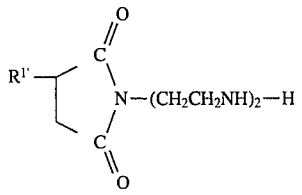

(wherein $R^{1'}$ is a polyisobutenyl group having a molecular weight of 900)

B-2: $R^{3'}$—NH—$CH_2CH_2$—$NH_2$ (wherein $R^{3'}$ is a polyisobutenyl group having a molecular weight of 800)

B-3:

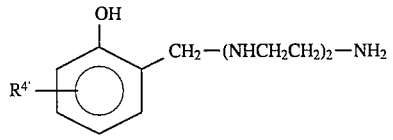

(wherein $R^{4'}$ is a polyisobutenyl group having a molecular weight of 800)

B-4:

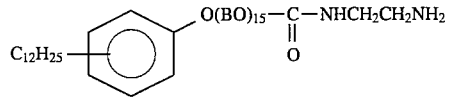

(wherein BO represents 1,2-butylene oxy group)

B-5:

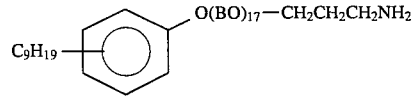

(wherein BO represents an alkylene oxy group consisting of 1,2-isomer, 2,3-isomer and iso-isomer of butylene oxide)

B-6:

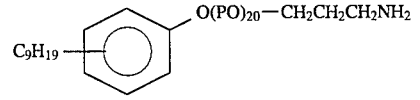

(wherein PO represents propylene oxy group)

C-1: 1,2-Butylene oxide (17 mols) adduct to nonyl phenol

C-2: Propylene oxide (20 mols) adduct to dodecyl phenol

C-3: Butylene oxide (a mixture of 1,2-isomer, 2,3-isomer and iso-isomer; 15 mols) adduct to nonyl phenol C-4: Propylene oxide (20 mols) adduct to nonyl phenol

TABLE 1

| Component | Amount (ppm) | Deposit at intake valve (mg/valve) |
|---|---|---|
| None | — | 1305 |
| A-1 | 200 | 850 |
| A-2 | 200 | 785 |
| A-3 | 200 | 812 |
| B-1 | 200 | 1507 |
| B-2 | 200 | 1378 |
| B-3 | 200 | 1246 |
| B-4 | 200 | 1120 |

TABLE 1-continued

| Component | Amount (ppm) | Deposit at intake valve (mg/valve) |
|---|---|---|
| B-5 | 200 | 1246 |
| B-6 | 200 | 1263 |
| B-1/A-1 | 100/100 | 512 |
| B-2/A-2 | 100/100 | 479 |
| B-1/C-1 | 100/100 | 872 |
| B-2/C-2 | 100/100 | 1113 |
| B-3/C-1 | 100/100 | 1321 |
| B-4/C-2 | 100/100 | 868 |
| B-5/A-3 | 100/100 | 912 |
| B-6/A-2 | 100/100 | 948 |
| B-1/A-1/C-1 | 80/60/60 | 312 |
| B-2/A-2/C-2 | 80/60/60 | 253 |
| B-3/A-3/C-1 | 80/60/60 | 183 |
| B-4/A-2/C-1 | 80/60/60 | 112 |
| B-5/A-1/C-1 | 20/100/80 | 231 |
| B-6/A-2/C-2 | 20/100/80 | 210 |
| B-1/B-3/A-1/C-1 | 30/50/80/40 | 304 |
| B-2/B-5/A-1/C-2 | 40/40/100/20 | 217 |
| B-6/A-1/C-4 | 95/10/95 | 81 |
| B-5/A-2/C-1 | 80/20/100 | 103 |
| B-4/A-3/C-3 | 80/20/100 | 107 |

TABLE 2

| Component | Amount (ppm) | Deposit at intake valve (mg/valve) |
|---|---|---|
| None | — | 1310 |
| A-4 | 200 | 925 |
| A-5 | 200 | 989 |
| A-6 | 200 | 1003 |
| A-4/B-1 | 100/100 | 621 |
| A-5/B-2 | 100/100 | 587 |
| A-6/B-3 | 100/100 | 476 |
| A-4/B-4 | 100/100 | 721 |
| A-5/B-5 | 100/100 | 613 |
| A-6/B-6 | 100/100 | 644 |
| A-4/C-1 | 100/100 | 721 |
| A-5/C-2 | 120/80 | 651 |
| A-6/C-3 | 100/100 | 593 |
| A-4/C-4 | 120/80 | 635 |
| A-4/B-4/C-1 | 80/60/60 | 260 |
| A-5/B-1/C-2 | 80/60/60 | 309 |
| A-6/B-2/C-3 | 80/60/60 | 249 |
| A-4/B-3/B-4/C-4 | 80/30/30/60 | 347 |
| A-4/B-2/B-6/C-4 | 70/20/30/80 | 244 |
| A-4/B-6/C-4 | 10/95/95 | 115 |
| A-5/B-5/C-1 | 80/20/100 | 130 |

TABLE 3

| Component | Amount (ppm) | Deposit at intake valve (mg/valve) |
|---|---|---|
| None | — | 1305 |
| A-7 | 200 | 1344 |
| A-8 | 200 | 1721 |
| A-9 | 200 | 1467 |
| B-1 | 200 | 1507 |
| B-2 | 200 | 1378 |
| B-3 | 200 | 1246 |
| B-4 | 200 | 1199 |
| B-5 | 200 | 1287 |
| B-6 | 200 | 1413 |
| C-1 | 200 | 1320 |
| C-2 | 200 | 1513 |
| C-3 | 200 | 1621 |
| C-4 | 200 | 1407 |
| A-7/C-1 | 100/100 | 1260 |
| A-8/C-4 | 100/100 | 1196 |
| B-1/C-1 | 100/100 | 1021 |
| B-2/C-2 | 100/100 | 1113 |
| A-7/B-1 | 100/100 | 872 |

TABLE 3-continued

| Component | Amount (ppm) | Deposit at intake valve (mg/valve) |
|---|---|---|
| A-7/B-1/C-1 | 4/76/120 | 242 |
| A-8/B-2/C-2 | 4/76/120 | 381 |
| A-7/A-3/B-3/C-1 | 2/2/76/120 | 421 |
| A-8/A-4/B-4/C-1 | 2/2/76/120 | 473 |
| A-11/B-1/C-2 | 4/120/76 | 360 |
| A-12/B-2/C-2 | 4/120/76 | 405 |
| A-7/B-1/B-5/C-1 | 4/70/50/76 | 378 |
| A-8/B-3/B-6/C-2 | 4/70/50/76 | 366 |
| A-7/B-6/C-4 | 4/76/120 | 136 |
| A-8/B-5/C-1 | 4/76/120 | 140 |
| A-11/B-4/C-3 | 4/76/120 | 139 |

TABLE 4

| Component | Amount (ppm) | Deposit at intake valve (mg/valve) |
|---|---|---|
| None | — | 1305 |
| A-13 | 200 | 1482 |
| A-14 | 200 | 1421 |
| A-15 | 200 | 1530 |
| A-16 | 200 | 1515 |
| B-1 | 200 | 1507 |
| B-2 | 200 | 1378 |
| B-3 | 200 | 1246 |
| B-4 | 200 | 1414 |
| B-5 | 200 | 1119 |
| B-6 | 200 | 1237 |
| A-13/C-1 | 100/100 | 1216 |
| A-14/C-3 | 100/100 | 1334 |
| B-1/C-1 | 100/100 | 1005 |
| B-2/C-2 | 100/100 | 1113 |
| B-3/C-4 | 100/100 | 989 |
| B-4/C-1 | 100/100 | 1003 |
| A-13/B-1 | 100/100 | 872 |
| A-13/B-1/C-1 | 4/76/120 | 546 |
| A-14/B-3/C-2 | 4/76/120 | 491 |
| A-15/B-4/C-1 | 4/76/120 | 415 |
| A-16/B-2/C-1 | 4/76/120 | 483 |
| A-13/B-2/B-5/C-2 | 40/20/20/120 | 734 |
| A-14/B-3/B-6/C-3 | 40/20/20/120 | 813 |
| A-13/B-6/C-4 | 4/76/120 | 137 |
| A-14/B-5/C-1 | 4/76/120 | 145 |
| A-15/B-4/C-3 | 4/76/120 | 141 |

As can be seen from Tables 1–4, the compositions of the present invention to which components (a), (b), (c), and (d) are incorporated exhibited excellent intake valve detergency effects.

Obviously, numerous modifications and variations of the present invention are possible in light of the above teachings. It is therefore to be understood that within the scope of the appended claims, the invention may be practiced other than as specifically described herein.

What is claimed is:

1. A gasoline composition comprising, (a) gasoline, (b) 1–10,000 ppm of a deposit inhibitor or a detergent containing a basic nitrogen atom, (c) 1–10,000 ppm of a carrier oil, and (d) 1–5,000 ppm of an ester of a fatty acid and an alkylene oxide addition compound, wherein the compound to which the alkylene oxide is added has the following formula (1),

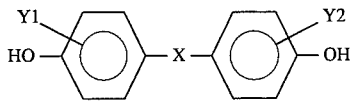

(1)

wherein X represents

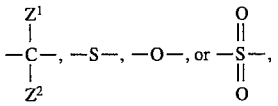

wherein $Z^1$ and $Z^2$ are individually a hydrogen atom, a trifluoromethyl group, or a substituted or unsubstituted alkyl or alkenyl group having 1–6 carbon atoms, or a phenyl group, and $Y^1$ and $Y^2$ are individually a hydrogen atom or a substituted or unsubstituted alkyl or alkenyl group having 1–6 carbon atoms, or a phenyl group.

2. The gasoline composition according to claim 1, wherein the component (b) is a compound selected from the group consisting of polyether amine compounds, long-chain alkylamine compounds, long-chain alkenylamine compounds, benzylamine compounds, and succinimide compounds.

3. The gasoline composition according to claim 1, wherein the component (b) is a compound selected from the group consisting of polyether amine compounds, long-chain alkylamine compounds, and long-chain alkenylamine compounds.

4. The gasoline composition according to claim 1, wherein the component (b) is a polyether amine compound.

5. The gasoline composition according to claim 1, wherein the component (b) is a polyether compound represented by formula (2-a).

6. The gasoline composition according to claim 1, wherein the component (c) is an alkylene oxide adduct to an alcohol or an alkylphenol containing 10–50 carbon atoms.

7. The gasoline composition according to claim 1, wherein the component (d) further comprises a compound obtained by the ester exchange reaction of an alcohol and a triglyceride fat or oil or an alkylene oxide adduct thereof.

8. The gasoline composition according to claim 1, wherein the component (d-1) is a fatty acid ester of alkylene oxide adduct to bisphenol A.

9. The gasoline composition according to claim 1, wherein the component (b) is a compound selected from the group consisting of polyether amine compounds, long-chain alkylamine compounds, and long-chain alkenylamine compounds, and the component (c) is an alkylene oxide adduct to an alcohol or an alkylphenol containing 10–50 carbon atoms.

10. The gasoline composition according to claim 1, wherein the component (b) is a compound selected from the group consisting of polyether amine-type compounds, long-chain alkylamine compounds, and long-chain alkenylamine compounds; the component (c) is an alkylene oxide adduct to an alcohol or an alkylphenol containing 10–50 carbon atoms; and the component (d) further comprises a compound obtained by the ester exchange reaction of an alcohol and a triglyceride fat or oil or an alkylene oxide adduct thereof.

11. The gasoline composition according to claim 1, wherein the ratio by weight of the component (b) to the component (d) is (b):(d)=99.5:0.5 to 70:30.

12. A gasoline composition comprising, (a) gasoline, (b) 1–10,000 ppm of a deposit inhibitor or a detergent containing a basic nitrogen atom, (c) 1–10,000 ppm of a carrier oil, and (d) 1–5,000 ppm of an ester of a fatty acid and an alkylene oxide addition compound, wherein the compound to which the alkylene oxide is added has the following formula (a),

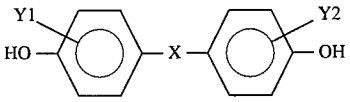

(1)

wherein X represents

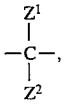

and $Z^2$ are individually a hydrogen atom, a trifluoromethyl group, or a substituted or unsubstituted alkyl or alkenyl group having 1–6 carbon atoms, or a phenyl group, and $Y^1$ and $Y^2$ are individually a hydrogen atom or a substituted or unsubstituted alkyl or alkenyl group having 1–6 carbon atoms, or a phenyl group.

* * * * *

UNITED STATES PATENT AND TRADEMARK OFFICE
CERTIFICATE OF CORRECTION

PATENT NO. : 5,522,906

DATED : June 4, 1996

INVENTOR(S) : Hashimoto et al.

It is certified that error appears in the above-identified patent and that said Letters Patent is hereby corrected as shown below:

Column 14, line 27, "formula (a)"
should read --formula (1)--.

Signed and Sealed this
Eighth Day of October, 1996

*Attest:*

Bruce Lehman

BRUCE LEHMAN

*Attesting Officer*

*Commissioner of Patents and Trademarks*